US008403326B1

(12) United States Patent
Flanagan et al.

(10) Patent No.: US 8,403,326 B1
(45) Date of Patent: Mar. 26, 2013

(54) GAME TABLE

(76) Inventors: Timothy D. Flanagan, Stanfordville, NY (US); Benjamin I. Cohen, Crested Butte, CO (US); Andrew M. Trachta, Stanfordville, NY (US)

( * ) Notice: Subject to any disclaimer, the term of this patent is extended or adjusted under 35 U.S.C. 154(b) by 0 days.

(21) Appl. No.: 13/290,690

(22) Filed: Nov. 7, 2011

(51) Int. Cl.

| | |
|---|---|
| ***A63F 7/06*** | (2006.01) |
| ***A63F 7/20*** | (2006.01) |
| ***A63F 7/30*** | (2006.01) |
| ***A63F 7/36*** | (2006.01) |

(52) U.S. Cl. ..... 273/123 R; 273/118 R; 273/108.1; 273/108.51; 273/108.54; 273/317; 273/317.1; 273/348; 273/398; 273/401; 273/402; 273/119 R

(58) Field of Classification Search ..... 273/108, 273/118 R, 118 A, 119 R, 119 A, 123 R, 273/123 A, 127 R, 108.52, 108.54, 317, 317.1, 273/348, 398, 399, 401, 402; D21/318
See application file for complete search history.

(56) References Cited

U.S. PATENT DOCUMENTS

| | | | | |
|---|---|---|---|---|
| 2,180,123 | A * | 11/1939 | Smith | 273/108.1 |
| 2,753,187 | A * | 7/1956 | Orsini | 273/120 R |
| 5,069,460 | A | 12/1991 | Kulesza | |
| 5,810,362 | A | 9/1998 | Jensen | |
| 6,663,108 | B2 * | 12/2003 | Makhoul | 273/317.3 |
| 7,389,986 | B2 * | 6/2008 | Tsai | 273/108.1 |
| 2003/0197326 | A1 * | 10/2003 | Makhoul | 273/108.54 |
| 2004/0195762 | A1 * | 10/2004 | Oister et al. | 273/108.1 |
| 2004/0239034 | A1 * | 12/2004 | Tien | 273/317.3 |
| 2006/0197278 | A1 * | 9/2006 | Tsai | 273/108.1 |
| 2006/0284370 | A1 * | 12/2006 | Chen | 273/108.1 |
| 2008/0093796 | A1 * | 4/2008 | Narus et al. | 273/108.1 |
| 2010/0194038 | A1 * | 8/2010 | Simon | 273/108.52 |

* cited by examiner

*Primary Examiner* — Raleigh W. Chiu
(74) *Attorney, Agent, or Firm* — Law Offices of Michael L. Wise, LLC

(57) ABSTRACT

A game table comprises a playing surface, two ramps, and two target boards arranged along a longitudinal axis of the game table. The two ramps are disposed between the two target boards, and the playing surface is disposed between the two ramps. The playing surface is substantially flat, and each of the two ramps rises upward away from the playing surface. Each of the two target boards, in turn, defines a respective set of openings therein. Two sidewalls are disposed on opposing sides of the playing surface and rise up therefrom.

20 Claims, 3 Drawing Sheets

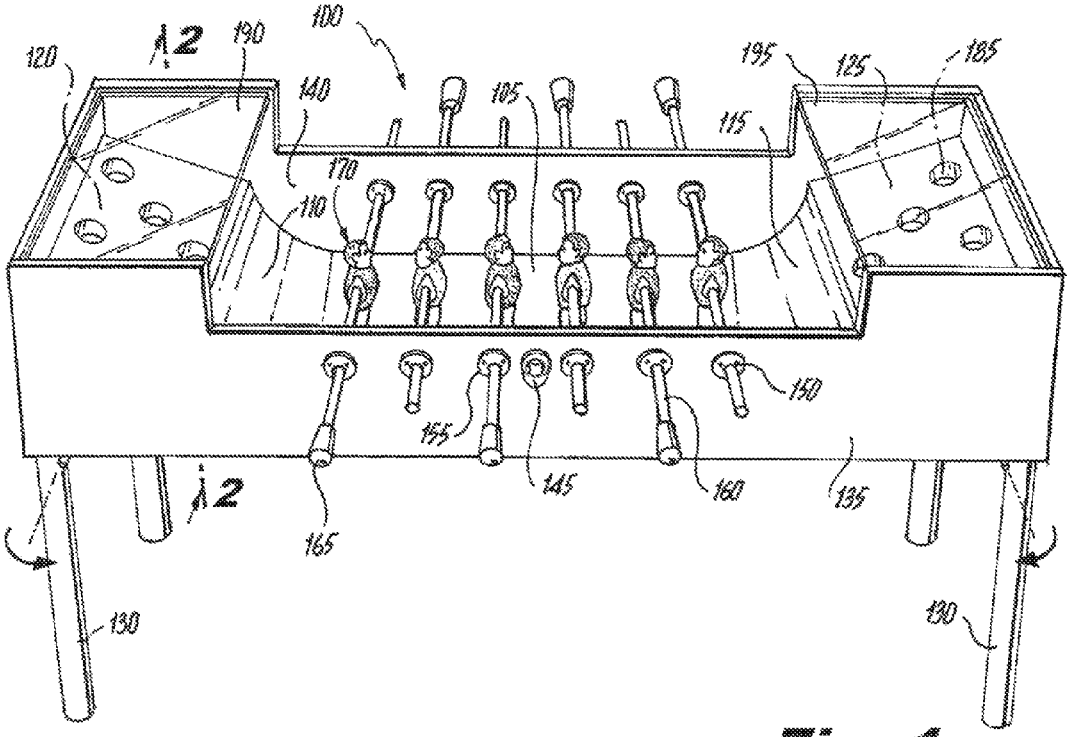
Fig. 1
Fig. 2
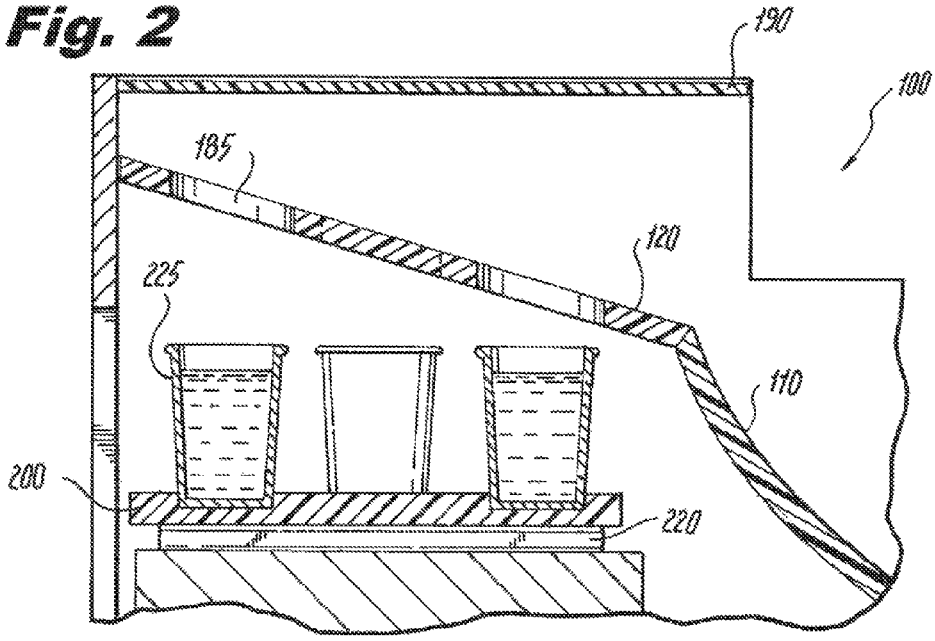

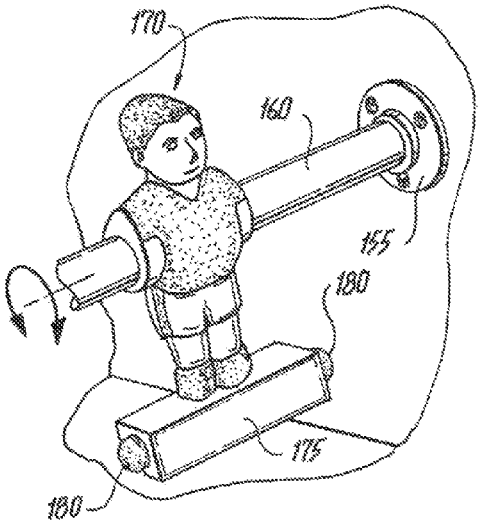
Fig. 5
Fig. 6
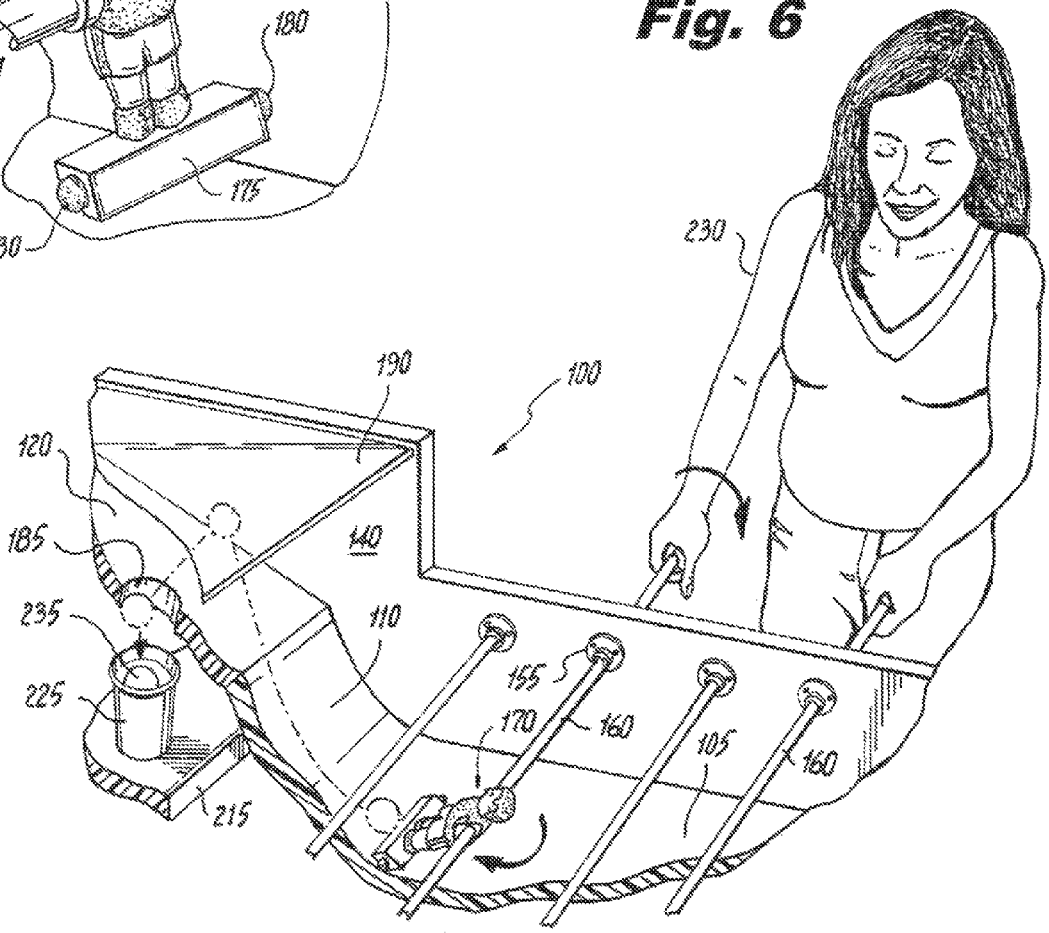
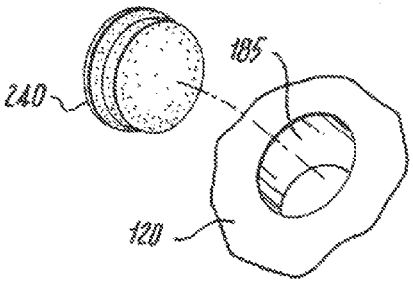
Fig. 7

GAME TABLE

FIELD OF THE INVENTION

The present invention relates generally to amusement devices, and, more particularly, to game tables.

BACKGROUND OF THE INVENTION

Game tables for table games such as foosball, pool, shuffleboard, and air hockey are commonly found in bars, arcades, nightclubs, bowling alleys, pool halls, and other such commercial establishments. Patrons of these establishments enjoy these table games because the games provide challenging gameplay, good-natured competition, and entertainment. At the same time, the owners of the commercial establishments appreciate table games because they tend to draw in customers and keep the customers at their establishments longer. The inclusion of table games in certain types of commercial establishments thereby becomes mutually beneficial for both patrons and business owners.

SUMMARY OF THE INVENTION

Embodiments of the claimed invention provide novel game tables that offer challenging gameplay, good-natured competition, and entertainment. At the same time, embodiments of the invention may be formed quite inexpensively and may be made more compact for transport, shipping, and storage.

In accordance with aspects of the invention, a game table comprises a playing surface, two ramps, and two target boards arranged along a longitudinal axis of the game table. The two ramps are disposed between the two target boards, and the playing surface is disposed between the two ramps. The playing surface is substantially flat, and each of the two ramps rises upward away from the playing surface. Each of the two target boards, in turn, defines a respective set of openings therein. Two sidewalls are disposed on opposing sides of the playing surface and rise up therefrom.

A game table according to an illustrative embodiment of the invention comprises a playing surface that is disposed between two ramps. The ramps, in turn, are disposed between two target boards that each defines a respective set of holes therein. During game play, the game table allows two opponents to utilize rods to actuate striking members positioned over the playing surface. In this manner, the players may competitively urge a ball towards one end of the game table or the other, resulting in fast action game play. When the ball is struck with sufficient force towards one end of the game table and not blocked by an opponent, the game table allows the ball to travel up one of the ramps and impinge on one of the target boards. There, it can fall through one of the openings in that target board and ultimately into an underlying cup, signifying a goal.

BRIEF DESCRIPTION OF THE DRAWINGS

These and other features, aspects, and advantages of the present invention will become better understood with regard to the following description, appended claims, and accompanying drawings where:

FIG. 1 shows a side perspective view of a game table in accordance with an illustrative embodiment of the invention;

FIG. 2 shows a sectional view of an end portion of the FIG. 1 game table;

FIG. 5 shows a perspective view of a striking member and rod within the FIG. 1 game table;

FIG. 6 shows a partially cutaway side perspective view of the FIG. 1 game table while being played; and FIG. 7 shows a perspective view of an opening and cap within the FIG. 1 game table.

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 3:
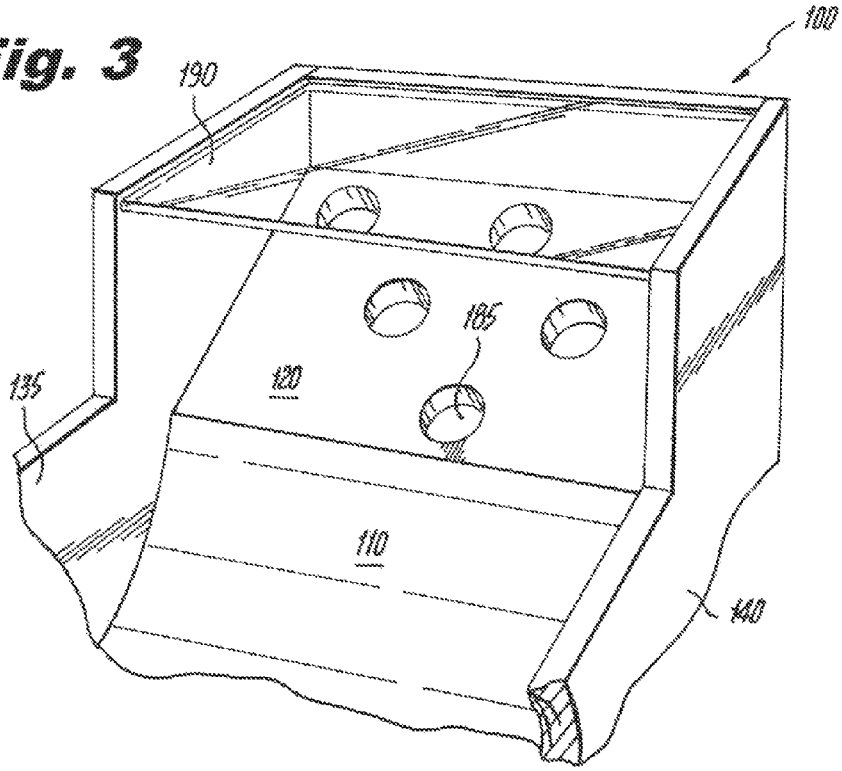
FIG. 3 shows a front perspective view of an end portion of the FIG. 1 game table.
Figure 4:
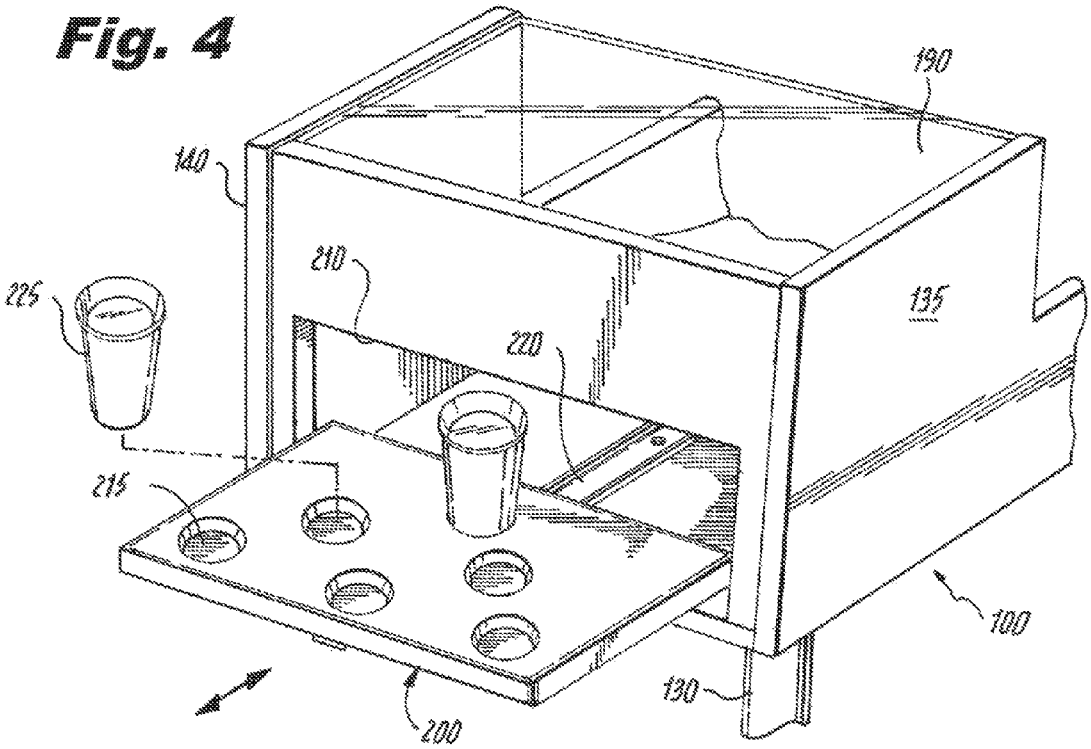
FIG. 4 shows a rear perspective view of an end portion of the FIG. 1 game table.

FIGS. 1-4 show various views of an exemplary game table 100 in accordance with an illustrative embodiment of the invention. More particularly, FIG. 1 shows a side perspective view of the game table 100, FIG. 2 shows a sectional view of an end portion of the game table 100, FIG. 3 shows a front perspective view of the end portion of the game table 100, and FIG. 4 shows a rear perspective view of the end portion of the game table 100.

The game table 100 comprises a playing surface 105, a left ramp 110, a right ramp 115, a left target board 120, and a right target board 125, which are collectively arranged along a longitudinal axis (i.e., lengthwise axis) of the game table 100. The playing surface 105 located at the center of the game table 100 is relatively flat. To either side of the playing surface 105, each of the ramps 110, 115 forms a respective arcuate surface that rises upward away from the playing surface 105. Lastly, the left target board 120 is disposed adjacent to an uppermost edge of the left ramp 110, and the right target board 125 is disposed adjacent to an uppermost edge of the right ramp 115. The two ramps 110, 115 are thereby disposed between the two target boards 120, 125, and the playing surface 105 is disposed between the two ramps 110, 115. Like the ramps 110, 115, the target boards 120, 125 are also angled upward away from the playing surface 105, although at a lesser angle than that described by the uppermost regions of the ramps 110, 115. Four legs 130 act to support the remainder of the game table 100.

A front sidewall 135 and a rear sidewall 140 are disposed on opposing sides of the playing surface 105, the ramps 110, 115, and the target boards 120, 125, and rise upward therefrom. The sidewalls 135, 140 are lower where they border the playing surface 105 and rise higher where they border the target boards 120, 125. At the center of the game table 100, a ball drop 145 like that found in conventional foosball tables is built into the front sidewall 135, allowing a ball to be introduced onto the playing surface 105 through that sidewall 135. On either side of the ball drop 145, the sidewalls 135, 140 define a plurality of opposing pairs of sidewall apertures 150. The sidewall apertures 150 are each reinforced with a respective set of bearings 155. Each opposing pair of sidewall apertures 150 and their associated bearings 155, in turn, support a respective rod 160 that passes above the playing surface 105. Supported in this manner, each of the rods 160 is both manually rotatable about its longitudinal axis and manually translatable along a transverse axis (i.e., a crosswise axis) of the game table 100. Each of the rods 160 terminates in a respective handle 165, with the handles 165 alternating between the front and rear of the game table 100 as one moves from rod to rod 160 along the length of the game table 100.

Fixedly mounted on each of the rods 160 is a respective striking member 170. FIG. 5 shows a perspective view of one of the striking members 170 in accordance with an illustrative embodiment of the invention. For purposes of simulating a "real-life" sport such as soccer or football, the striking member 170 has a somewhat humanoid appearance, although such an appearance is entirely optional. Near the bottom of the striking member 170 is a kicking block 175. In the present embodiment of the invention, the kicking block 175 is somewhat wider than the remainder of the striking member 170 so as to occupy a greater width of the game table 100. On opposing sides of the kicking block 175 are rubber bumpers 180 that reduce the possibility of having the kicking block 175 cause damage to the sidewalls 135, 140 when collisions occur therebetween.

In accordance with aspects of the invention, the left and right target boards 120, 125 each define a respective set of openings 185 therein. In the present example, each set consists of six openings 185 arranged in an equilateral triangle. A left backboard 190 overlies the left target board 120 and a right backboard 195 overlies the right target board 125. Each of the two backboards 190, 195 comprises a flat sheet of material and thereby defines a respective lowermost surface (i.e., a surface that faces the underlying target board 120, 125) that is substantially parallel to the playing surface 105. For purposes of visualizing the openings 185 in the target boards 120, 125, the backboards 190, 195 are preferably substantially transparent.

Lastly, underneath the left and right target boards 120, 125 are two shelves 200, which are arranged such that they form mirror images of one another. One of the two shelves 200 is visible in FIG. 4. Each of the shelves 200 is manually translatable along a respective portion of the longitudinal axis of the game table 100 through respective access openings 210 in the lengthwise ends of the game table 100. Each of the shelves 200 may thereby be positioned forward within a housing formed by the sidewalls 135, 140 and the respective overlying target board 120, 125 (i.e., in what is hereinafter called the "playing position"), or, alternatively, translated rearward so that the shelf 200 is outside that housing (as shown in FIG. 4, in what is hereinafter called the "loading position") and easily accessible from both the sides and above. The uppermost surface of each shelf 200 defines a respective plurality of circular recessed regions 215 therein. These circular recessed regions 215 line up with the openings 185 in the overlying target boards 120, 125 when the shelves 200 are in their playing positions. In the present embodiment, the shelves 200 are slidably attached to the underlying game table 100 by conventional drawer slides 220. Nevertheless, any suitable means of attachment may be utilized and the results would still come within the scope of the invention.

Advantageously, the aforementioned components combine together to form an entirely novel table game capable of providing challenging gameplay, good-natured competition, and entertainment. In one of many variants of game play that the game table 100 offers, conventional drinking cups 225 may be placed in the recessed regions 215 of the shelves 200 and the shelves 200 positioned in their playing positions such that the cups 225 underlie the openings 185 in the target boards 120, 125 (see FIGS. 2 and 4). If desired, the cups 225 may be filled with a beverage if it is preferred that the game be associated with drinking. Two players may then take position on opposing sides of the game table 100 so that one player can manipulate that set of rods 160 having handles 165 at the front of the game table 100 and the other player can manipulate those rods 160 having handles 165 at the rear of the game table 100. A ball may then be introduced onto the playing surface 105 through the ball drop 145.

The exemplary game table 100 is adapted such that a ball with sufficient velocity may travel up one of the two ramps 110, 115 and impinge on the adjacent target board 120, 125. When describing this trajectory, the ball may or may not strike the associated backboard 190, 195, depending on its velocity and direction. Once on one of the target boards 120, 125, the ball may drop into an opening 185 in the target board 120, 125 and ultimately into an underlying cup 225. It therefore becomes an object of the game for each player to manipulate those rods 160 under their control so as to urge the ball towards the other player's ramp 110, 115 and target board 120, 125. As drawn in FIG. 1, the player at the front of the table would attempt to urge the ball towards the right, and the player at the rear of the table would attempt to urge the ball towards the left. Manipulating a particular rod 160 allows a player to move the attached striking member 170 transversely across the playing surface 105. At the same time, rotating that particular rod 160 about its longitudinal axis allows the player to also rotate the striking member 170 in the same manner and thereby allows the striking member 170 to strike the ball when the ball is located underneath the rod 160. Fast action game play ensues as each player attempts to strike the ball such that it bypasses their opponent's striking members 170 while trying to block the other player from doing the same.

A player may achieve a goal when that player successfully urges the ball past their opponent's striking members 170 and causes the ball to travel up one of the ramps 110, 115 and ultimately drop into one of the openings 185 in their assigned target board 120, 125. FIG. 6 shows a partially cutaway side perspective view of the game table 100 while being played when such an event occurs. Here a rear player 230 strikes a ball 235 such that it travels up the left ramp 110, impinges on the left backboard 190, and is reflected back towards the left target board 120, where it ultimately drops into an opening 185. Once through the opening 185, the ball drops into the underlying cup 225. After such an event occurs, the ball 235 and the cup 225 may be accessed by simply sliding the shelf 200 that underlies the left target board 120 into its loading position. If the game play is associated with drinking beverages, the player on which the goal was scored may be urged to drink any liquid in that particular cup.

The cup 225 may then be replaced and the game allowed to continue. Alternatively, depending on the rules of the game, the cup 225 may be removed from the shelf 200 that underlies the left target board 120 and a cap 240 placed into the hole overlying that cup 225. FIG. 7 shows a perspective view of such a cap 240 and its associated opening 185 in the left target board 120. The cap 240 is adapted to substantially fill an opening 185 in the target boards 120, 125. The cap 240 preferably defines a relatively flat uppermost surface so that it does not significantly interfere with remainder of the game play.

Once the novel elements of the exemplary game table 100 are understood, they may be formed by one having ordinary skill in the mechanical arts utilizing readily available materials and conventional manufacturing techniques. The playing surface 105, the ramps 110, 115, the target boards 120, 125, the striking members 170, the shelves 200, and the sidewalls 135, 140 preferably comprise wood, plastic, or a combination thereof. The backboards 190, 195, in turn, preferably comprise clear plexiglass. Finally, the rods 160 and the legs 130 preferably comprise wood, plastic, metal, or a combination thereof. Conventional foosball balls or Ping-Pong balls (i.e., table tennis balls) may be utilized to play the game. The bearings 155 may be conventional foosball bearings.

For purposes of making the game table more compact for transport, shipping, and storage, the four legs 130 may fold in a manner similar to the legs on a conventional folding card table, as will already be familiar to one skilled in the art. Alternatively, the legs 130 may be individually inserted into respective receiving slots in the underside of the game table

100 and held therein by fasteners such as, but not limited to, set screws, cotter pins, and the like (not specifically shown).

Preferable, but entirely non-limiting, dimensions are suggested by several prototypes that were studied while developing aspects of the invention. A non-limiting, illustrative embodiment of the invention may, as just one example, comprise a game table 100 that is about 84 inches long and about 18 inches wide (when considered top down). Of the about 84 inches of length, the playing surface 105 may occupy about 40 inches, each of the ramps 110, 115 may occupy about 8 inches, and each of the target boards 120, 125 may occupy about 14 inches. With regard to height, each of the ramps 110, 115 may rise about 8 inches above the playing surface 105, while each of the target boards 120, 125 may rise an additional about 4 inches above the tops of the ramps 110, 115. The backboards 190, 195 may be supported about 14 inches above the playing surface 105. Finally, the sidewalls 135, 140 may rise about five inches above the playing surface 105 proximate to the playing surface 105, and rise about 14 inches above the playing surface 105 proximate to the target boards 120, 125.

Nevertheless, with regard to these dimensions as well as all other aspects of the above-described embodiments, it should again be emphasized that these embodiments of the invention are intended to be illustrative only. As a result, other embodiments can use different types and arrangements of elements, as well as different dimensions, for implementing the described functionality. As just one example, alternative embodiments of the invention may contain less than six rods (e.g., four rods) or greater than six rods (e.g., eight rods). In a similar manner, alternative embodiments may implement more than one striking member per rod. Lastly, as even one more example, other numbers of openings and different arrangements of openings may be implemented in the target boards. In an alternative embodiment, for example, each target board may define ten respective openings arranged such that nine openings form an equilateral triangle and a single opening occupies the center of the triangle. These numerous alternative embodiments within the scope of the appended claims will be apparent to one skilled in the art.

Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Any element in a claim that does not explicitly state "means for" performing a specified function or "step for" performing a specified function is not to be interpreted as a "means for" or "step for" clause as specified in 35 U.S.C. §112, Paragraph 6. In particular, the use of "step of" in the claims herein is not intended to invoke the provisions of 35 U.S.C. §112, Paragraph 6.

What is claimed is:

1. A game table comprising:

two target boards, each of the two target boards defining a respective set of openings therein;

two ramps, the two ramps disposed between the two target boards;

a playing surface, the playing surface disposed between the two ramps and being substantially flat; and two sidewalls, the two sidewalls disposed on opposing sides of the playing surface and rising up therefrom;

wherein each of the two ramps rises upward away from the playing surface;

wherein the two target boards, the two ramps, and the playing surface are arranged along a longitudinal axis of the game table.

2. The game table of claim 1, wherein each of the two target boards is angled upward away from the playing surface.

3. The game table of claim 1, wherein each of the two target boards at least defines six respective openings arranged in an equilateral triangle.

4. The game table of claim 1, wherein each of the two target boards is disposed adjacent to an uppermost edge of a respective one of the two ramps.

5. The game table of claim 1, further comprising a cap, the cap adapted to substantially fill an opening defined by one of the two target boards.

6. The game table of claim 1, further comprising two backboards, each of the two backboards overlying at least a portion of a respective one of the two target boards.

7. The game table of claim 6, wherein each of the two backboards comprises a respective lowermost surface substantially parallel to the playing surface.

8. The game table of claim 6, wherein the two backboards are at least partially substantially transparent.

9. The game table of claim 1, further comprising a rod, the rod at least partially supported by opposing apertures in the two sidewalls so that the rod passes above the playing surface.

10. The game table of claim 9, wherein the rod is manually rotatable about a longitudinal axis of the rod and manually translatable along a transverse axis of the game table.

11. The game table of claim 10, further comprising a striking member, the striking member fixedly attached to the rod, wherein manually moving the rod can cause the striking member to strike a ball disposed underneath the rod on the playing surface.

12. The game table of claim 11, wherein the striking member comprises a kicking block at one end that strikes the ball when the rod causes the striking member to strike the ball, the kicking block being substantially wider than the remainder of the striking member.

13. The game table of claim 11, wherein the striking member is operative to strike the ball such that the ball travels up one of the two ramps and impacts one of the two target boards.

14. The game table of claim 11, further comprising two backboards, each of the two backboards overlying at least a portion of a respective one of the two target boards, wherein the striking member is operative to strike the ball such that the ball travels up one of the two ramps, impacts one of the two backboards, and impacts one of the two target boards.

15. The game table of claim 1, wherein each of the two ramps forms a respective arcuate surface.

16. The game table of claim 1, further comprising two shelves, each of the two shelves being manually translatable along a respective portion of the longitudinal axis of the game table.

17. The game table of claim 16, wherein each of the two shelves is translatable so that it underlies at least a portion of a respective one of the two target boards.

18. The game table of claim 16, wherein each of the two shelves comprises a respective uppermost surface that defines a respective plurality of circular recessed regions.

19. The game table of claim 1, further comprising one or more legs adapted to support the remainder of the game table.

20. The game table of claim 19, wherein the one or more legs are at least one of manually removable and manually foldable.

* * * * *